US006354016B1

(12) United States Patent
Cafaro

(10) Patent No.: US 6,354,016 B1
(45) Date of Patent: Mar. 12, 2002

(54) DUAL IN-LINE STYLING HAIR DRYER

(75) Inventor: Michael Cafaro, El Paso, TX (US)

(73) Assignee: Helen of Troy, L.P., El Pasco, TX (US)

( * ) Notice: Subject to any disclaimer, the term of this patent is extended or adjusted under 35 U.S.C. 154(b) by 0 days.

(21) Appl. No.: 09/780,703

(22) Filed: Feb. 12, 2001

(51) Int. Cl.[7] ..... A45D 20/10

(52) U.S. Cl. ..... 34/98; 34/96; 34/283; 392/380; 392/385

(58) Field of Search ..... 34/96, 97, 98, 34/283; D28/12, 13, 14, 15; 392/380, 385

(56) References Cited

U.S. PATENT DOCUMENTS 4,044,474 A * 8/1977 Greene et al. ..... 34/86
4,218,608 A * 8/1980 Maroney ..... 219/368
4,384,411 A * 5/1983 Steigler et al. ..... 34/99
D380,540 S 7/1997 Seatvet et al.
D425,664 S 5/2000 Elkerbout
6,148,537 A * 11/2000 Altamore ..... 34/97

FOREIGN PATENT DOCUMENTS

DE 3234013 A1 * 3/1984
EP 0 400 381 A2 12/1990

* cited by examiner

*Primary Examiner*—Denise L. Esquivel
*Assistant Examiner*—Greg T. Warder
(74) *Attorney, Agent, or Firm*—John E. Toupal; Harold G. Jarcho

(57) ABSTRACT

A dual in-line portable electric hair drying appliance includes independently operational heaters to provide optimized performance and a multitude of operating conditions that are found to be advantageous in the drying and styling of hair.

14 Claims, 6 Drawing Sheets

DUAL IN-LINE STYLING HAIR DRYER

FIELD OF THE INVENTION

The present invention relates generally to hair-drying and styling appliances. More specifically, the present invention is a hand-held electric hair-drying and styling appliance comprising independently controlled dual in-line drying barrels.

BACKGROUND OF THE INVENTION

Hand-held electric hair-drying and styling appliances are well known. In such prior art dryers, it is most common to employ a single tubular barrel in which is housed a heating element and through which is directed airflow from a blower, which airflow is heated by the heater and exhausted from the barrel toward the hair for drying or styling thereof.

It has been recognized that there are advantages to diffusing and splitting the heated airflow into two or more individual air streams. U.S. Pat. Nos. Des. 425,664 and Des. 380,540, and EPO patent application 0400381-A2, depict such prior art dual in-line hair-dryers. A deficiency of these prior art dryers is that they lack independence between the two heated air streams. Because the air streams are both heated by the same heating element and propelled by the same blower, both air streams must inherently operate the same at any given time.

It is found that the styling effects of the dual air streams are enhanced when one air stream is operated at a cooler temperature than the other. The curling effects realized when the hair is treated by dual air streams having such differing temperatures is found to be unique; curls in straight hair are better created and natural curliness is accentuated. This is possibly the result of having the hair subjected to a hot air stream, then cooler air, and then another hot air stream as the dryer is passed over the hair, or possibly the result of the uneven tempering of the hair when the dryer is held still.

Another disadvantage to prior art dual in-line hair-dryers is that they require a dedicated heater/blower subassembly. Many manufacturers of such appliances also manufacture other single barrel dryers and desire to reduce the inventory of components. The ability to share components between various models can be extremely economical and advantageous. The ability to use a pair of heater/blower subassemblies that are also shared with other single barrel models would provide numerous manufacturing advantages.

OBJECTS AND SUMMARY OF THE INVENTION

It is an object of the present invention to provide an improved portable electric hair-drying and styling appliance.

It is a further object to provide a dual in-line portable electric hair-drying and styling appliance in which the heat from each barrel is independently controllable.

It is a further object of the present invention to provide a dual in-line portable electric hair-drying and styling appliance that uses a pair of heater/blower subassemblies which are common to another drying appliance so that the inventory of those subassemblies may be economically shared in the manufacturing of this and that other appliance.

It is still a further object to provide a dual in-line portable electric hair-drying and styling appliance having all of the above advantages.

Further objects and advantages of the present invention will be best appreciated and more fully understood in reference to the herein described preferred embodiment and the appended drawings, of which the following is a brief description.

DESCRIPTION OF THE PREFERRED EMBODIMENT

Figure 1:
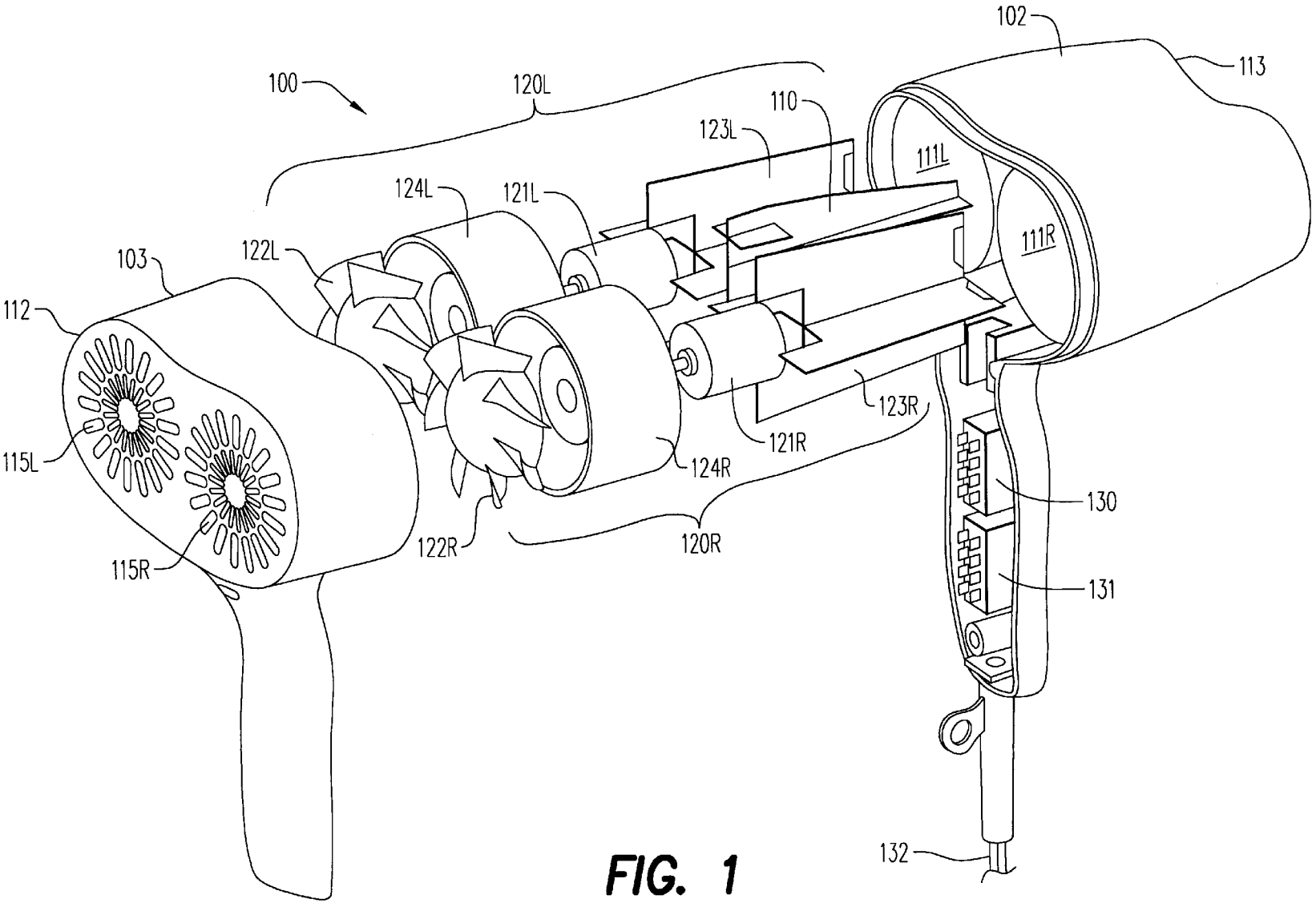
FIG. 1 is an exploded assembly of a dual in-line portable electric hair-drying and styling appliance in accordance with the preferred embodiment of the invention.
Figure 2:
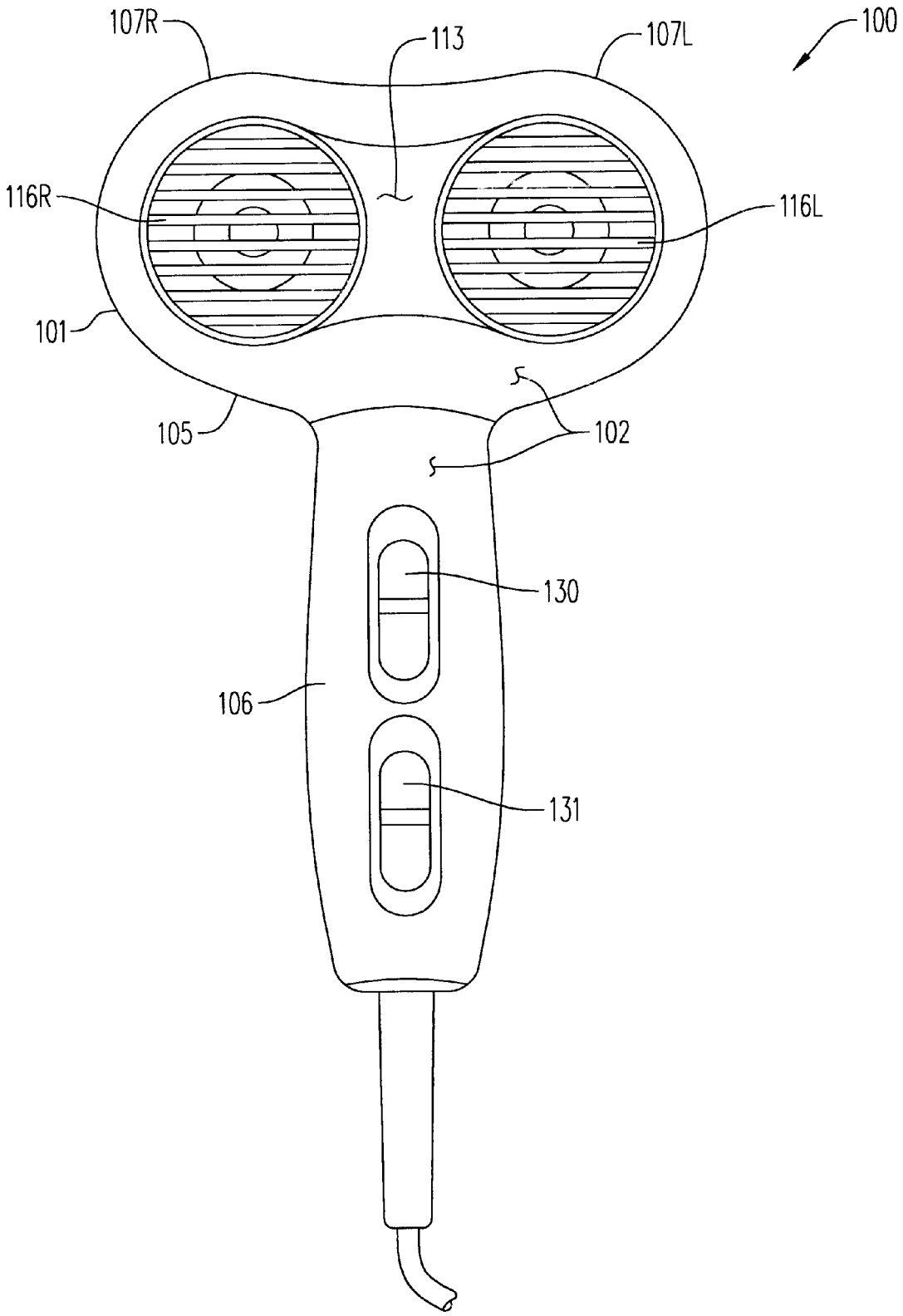
FIG. 2 is a view of the appliance of FIG. 1 from the exhaust end.
Figure 3:
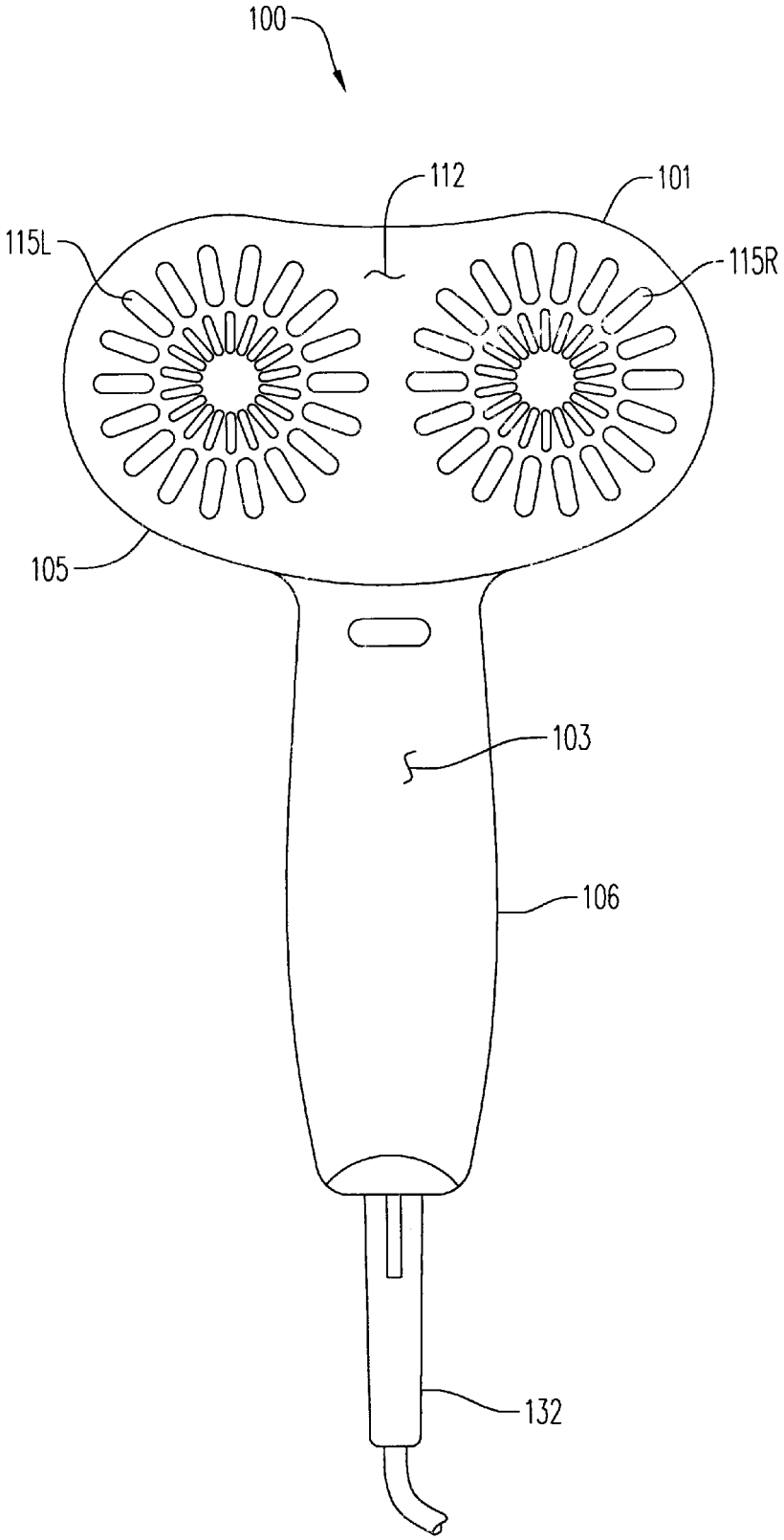
FIG. 3 is a view of the appliance of FIG. 1 from the intake end.
Figure 4:
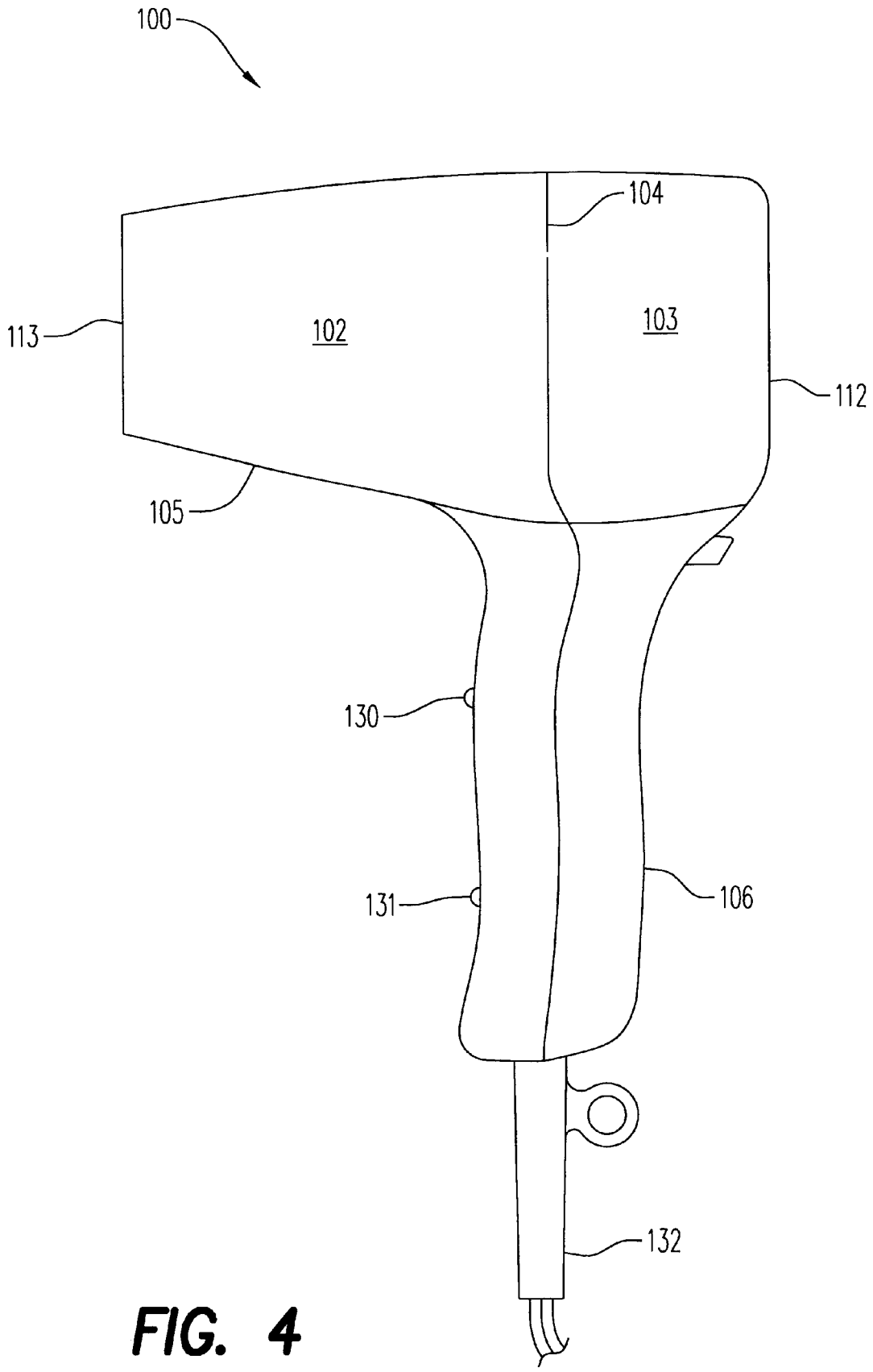
FIG. 4 is a side view of the appliance of FIG. 1.
Figure 5:
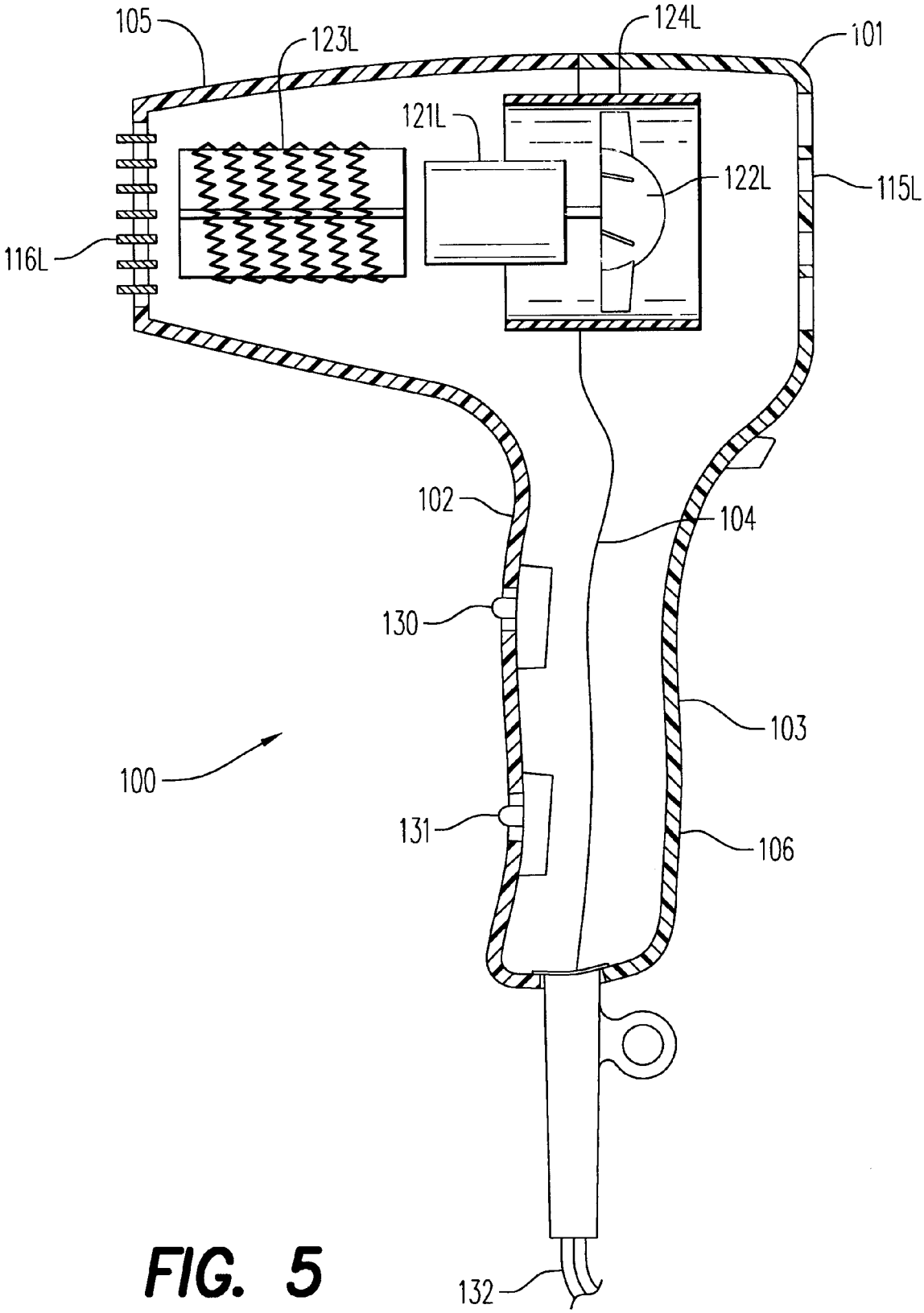
FIG. 5 is a side sectional view of the appliance of FIG. 1.
Figure 6:
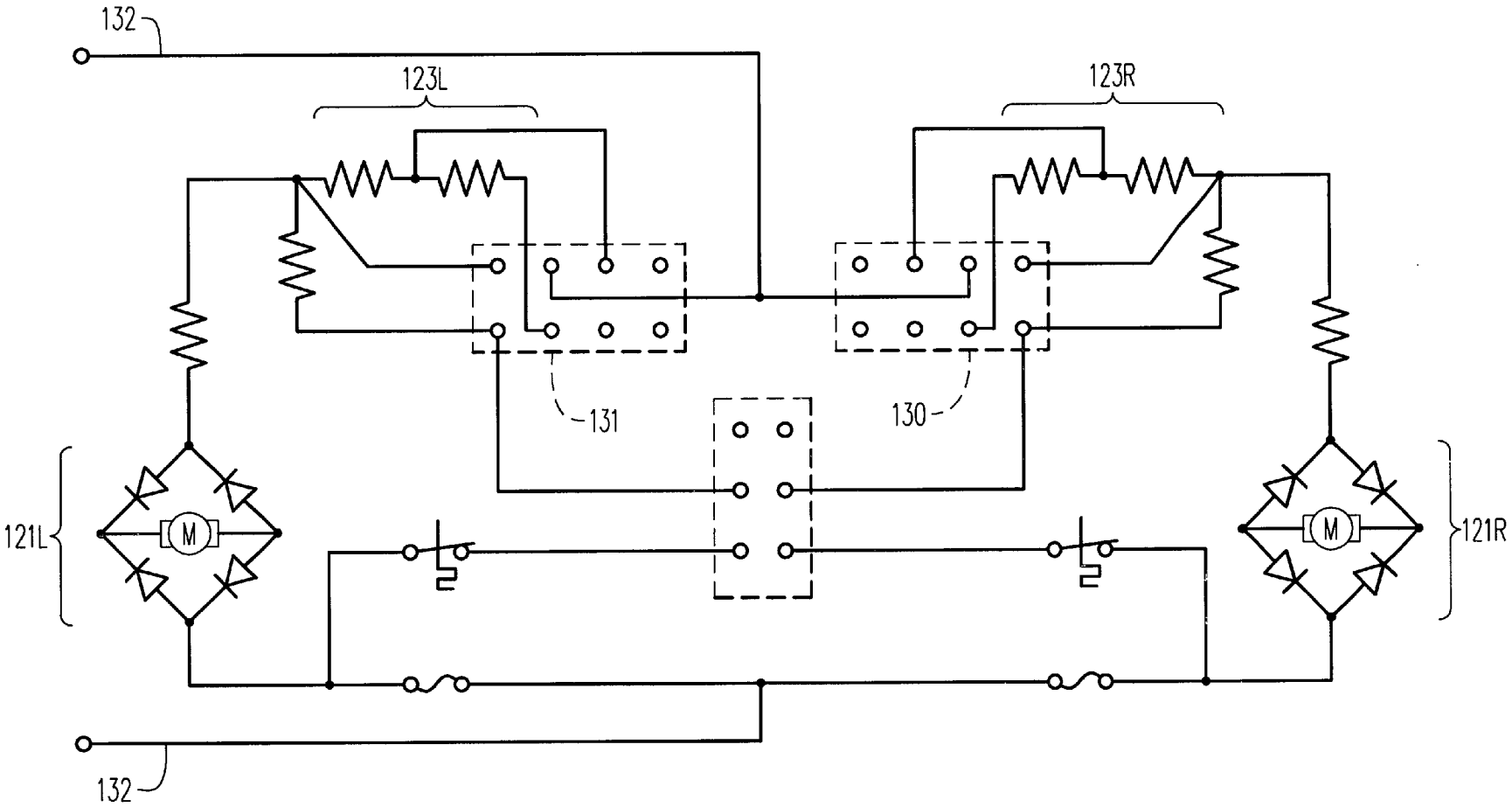
FIG. 6 is a diagram of the electrical circuit of the appliance of FIG. 1.

A dual in-line portable electric hair-drying and styling appliance 100 in accordance with the preferred embodiment of the invention is depicted in FIGS. 1 through 5.

Housing 101 includes front portion 102 and rear portion 103, which join together along seam 104 and are attached by screws (not shown). Once joined, housing 101 forms an upper head portion 105, and a lower handle portion 106. The head portion comprises a left barrel 107L and a right barrel 107R. Inside the housing, barrel separator 110 separates the left and right barrels. The housing head and separator thereby form a hollow shell around each of the barrels to create interior ducts 111L and 111R, which each function as an air flow channel.

At the rear most end 112 of the barrels are provided intake grills 115L and 115R, for allowing air to enter each barrel, and at the opposite end 113 are provided exhaust grills 116L and 116R for allowing that air to escape towards the hair (not shown).

Within each barrel is positioned a heater/blower subassembly 120L or 120R which each comprises a motor 121L or 121R, a fan blade 122L or 122R, a heating element 123L or 123R, and a fan housing 124L or 124R to which these components are mounted to form together the heater/blower subassembly. The subassemblies are each fitted within the left and right interior ducts before the front and rear housings are fitted together to thereby align and encapsulate the subassemblies.

Each of the heating elements is adapted for either high, medium, or low temperature operation.

The blowers comprise axial fans each having a rotation tangent to the airflow direction within the associated barrel. The left motor 121L supplies airflow through the left barrel and the right motor 121R supplies airflow through the right barrel.

The identical heater/blower subassemblies 120L and 120R are each comprised of components that are standard to other single barrel hair-dryers. Aside to other advantages, this commonality of components reduces the need to inventory additional components and thereby improves the economy of manufacturing this appliance.

Within the handle portion are located two switches; right barrel switch 130 and left barrel switch 131. The switches are connected to a standard power supply through power supply cord 132. Each switch is then connected to the appropriate heating element to independently control the temperature thereof. Each switch is a multi-position slide switch including "Off", "Cool", "Warm", and "Hot" positions, and controls the appropriate heating element according to that condition. In this way, each of the left and right barrels can provide any of the four conditions of operation while the other barrel can independently provide the same or any other one of these conditions, thereby providing up to sixteen distinct operating conditions for the appliance.

In the "Off" condition, the appropriate barrel is de-energized so that the motor and heating element are not operational. In the "Cool" condition, the appropriate heating element is energized at 300 Watts so that relatively cool air flows from that barrel. In the "Warm" condition, the appropriate heating element is energized at 600 Watts so that warm air flows from that barrel. In the "Hot" condition, the appropriate heating element is fully energized at 900 Watts so that hot air flows from that barrel. It can be appreciated that any combination of these wattages can be simultaneously delivered from the pair of barrels.

It is found that simultaneously operating each barrel at different temperatures results in unique curling effects on the hair. For instance, operating the left barrel on "Cool" while operating the right barrel on "Hot" causes the hair to curl more to the left. Alternately, operating the right barrel on "Cool" while operating the left barrel on "Hot" would cause that hair to curl more to the right.

The aforesaid ability for the present invention to operate in such an asymmetrical manner makes it desirable for the appliance to be equally convenient for operation with the right or left hand, so that the appliance can be moved from one side of the head to the other. For instance, it may be desirable to use the dryer on the right side of the head with the right hand and with the right barrel operating on a cooler setting than the left, then to move the appliance to the left side of the head and into the left hand and change the setting so that the left barrel is operating on a cooler setting than the right. This would be a practical method for causing the hair on both sides of the head to curl forward. It is therefore desirable to change the operational conditions with either hand. Switches 130 and 131 are therefore symmetrically positioned and adapted for equally convenient operation by either the right or left hand.

It is also found that simultaneously operating each barrel under the same condition results in more efficient hair-drying, as a result of the improved dispersement of the airflow versus traditional single barrel appliances.

Those skilled in the art will recognize that there are many variations of the invention that are within the scope of the invention, therefore, the invention is to be defined only by the limitations and the equivalents thereof which the following claims set forth.

What is claimed is:

1. A portable hair drying appliance comprising two or more substantially parallel and distinct airflow channels, each of said channels comprising:

an intake opening;

an exhaust opening; said exhaust openings of all said channels being arranged to direct air toward a limited common head region of a user;

a blower for pulling air into said channel through said intake opening, forcing said air through said channel. and pushing said air from said channel through said exhaust opening;

a heater for heating said air in said channel; and heat control means for each said heater so as to allow operation independently from said heater of another of said channels.

2. A portable hair drying apparatus according to claim 1 wherein each of said heaters has at least high temperature and low temperature heater operating conditions and wherein each of said heaters is operational independently from said heater of another of said channels at either of said heater operating conditions.

3. A portable hair drying apparatus according to claim 2 wherein each of said airflow channels further comprises a switch associated therewith for controlling said heater operating conditions.

4. A portable hair drying apparatus according to claim 3 further comprising a handle portion for grasping said appliance such that said substantially parallel airflow channels can be directed towards a head using either a right or left hand.

5. A portable hair drying apparatus according to claim 4 wherein said handle is symmetrically positioned relative to said airflow channels.

6. A portable hair drying apparatus according to claim 5 wherein said handle portion comprises each of said switches and wherein said switches are positioned for operation by either a right or left hand.

7. A portable hair drying apparatus according to claim 6 wherein said switches are symmetrically positioned relative to said handle and said airflow channels.

8. A portable hair drying apparatus according to claim 1 wherein said two or more substantially parallel airflow channels are two airflow channels.

9. A portable hair drying apparatus according to claim 8 wherein at least one of said heaters has at least high temperature and low temperature heater operating conditions and wherein said at least one of said heaters is operational independently from said other heater at either of said heater operating conditions.

10. A portable hair drying apparatus according to claim 9 wherein each of said airflow channels further comprises a switch associated therewith for controlling said heater operating conditions.

11. A portable hair drying apparatus according to claim 10 further comprising a handle portion for grasping said appliance such that said substantially parallel airflow channels can be directed towards a head using either a right or left hand.

12. A portable hair drying apparatus according to claim 11 wherein said handle is symmetrically positioned relative to said airflow channels.

13. A portable hair drying apparatus according to claim 12 wherein said handle portion comprises each of said switches and wherein said switches are positioned for operation by either a right or left hand.

14. A portable hair drying apparatus according to claim 13 wherein said switches are symmetrically positioned relative to said handle and said airflow channels.

* * * * *